United States Patent [19]

Henning

[11] Patent Number: 4,916,969

[45] Date of Patent: Apr. 17, 1990

[54] ELECTRIC TROLLING MOTOR STEERING HANDLE

[76] Inventor: Peter Henning, 405 NE. First St., Belle Glade, Fla. 33430

[21] Appl. No.: 37,830

[22] Filed: Apr. 13, 1987

Related U.S. Application Data

[63] Continuation-in-part of Ser. No. 807,776, Dec. 11, 1985, abandoned, which is a continuation of Ser. No. 564,489, Dec. 22, 1983, abandoned.

[51] Int. Cl.[4] ..... G05G 1/10

[52] U.S. Cl. ..... 74/543; 74/480 B; 114/144 R; 403/91

[58] Field of Search ..... 74/480 B, 543, 544, 74/480 R, 551.8, 524, 525; 114/144 R; 440/6, 63; 16/244, 245, 340; 403/91, 92, 99, 97, 72

[56] References Cited

U.S. PATENT DOCUMENTS

| | | | |
|---|---|---|---|
| 872,971 | 3/1907 | Porter | 74/543 |
| 912,157 | 2/1909 | Orr et al. | 403/91 |
| 1,854,196 | 4/1932 | Irgens | 440/63 |
| 2,081,053 | 5/1937 | Hobson | 74/543 |
| 2,478,858 | 8/1949 | Buske | 74/480 B |
| 2,559,421 | 7/1951 | Garrett | 403/84 X |
| 2,603,981 | 7/1952 | Snyder | 74/551.3 X |
| 2,685,331 | 8/1954 | Gauntlett et al. | 403/97 X |
| 2,724,981 | 11/1955 | Smart | 74/545 X |
| 2,747,425 | 5/1956 | Ohlau | 74/480 B |
| 2,901,918 | 9/1959 | Beamer | 74/480 B |
| 2,926,544 | 3/1960 | Carmichael, Jr. | 74/480 B |
| 3,274,849 | 9/1966 | Hanson | 74/544 X |
| 3,371,641 | 3/1968 | Rohman et al. | 440/63 X |
| 3,456,525 | 7/1969 | Oldham | 74/544 |
| 3,750,621 | 8/1973 | Hoyt | 440/63 |
| 3,875,610 | 4/1975 | Wubbe et al. | 403/97 X |
| 4,129,088 | 12/1978 | Foley | 440/6 X |
| 4,196,610 | 4/1980 | Chilton | 403/97 X |
| 4,386,918 | 6/1983 | Matthews et al. | 440/63 X |
| 4,480,571 | 11/1984 | Meyer | 74/544 X |
| 4,624,206 | 11/1986 | Fry et al. | 74/544 X |

FOREIGN PATENT DOCUMENTS

| | | | |
|---|---|---|---|
| 9414 | of 1908 | United Kingdom | 16/340 |
| 1045702 | 10/1966 | United Kingdom | 16/340 |

*Primary Examiner*—Rodney M. Lindsey

*Attorney, Agent, or Firm*—Malin, Haley, McHale, DiMaggio & Crosby

[57] ABSTRACT

An attachable steering handle for an electric trolling motor that includes a swivel, an adaptive shaft connected to the swivel, and a control handle shaft connected to the swivel. The attachable steering handle is connectable to the trolling motors by connecting the adaptive shaft to the motor shaft and to the motor control housing. The control handle shaft is positionable between an upper position and lower position, that are generally parallel to the motor shaft. The swivel includes two disk shaped spacers with a center hole in each spacer. A bolt is passed through the holes in the spacers and the head of the bolt is welded to one spacer. The bolt has a threaded end that protrudes out of the hole in the second spacer. A generally T-shaped handle having a threaded nut on the working end is provided to mate with the threaded end of the bolt. The handle is used to lock and unlock the swivel when the user adjusts the position of the control handle shaft with a soft handle on its distal end.

9 Claims, 2 Drawing Sheets

ELECTRIC TROLLING MOTOR STEERING HANDLE

This application is a continuation-in-part of Ser. No. 807,776, filed on Dec. 11, 1985, which is in turn a continuation of parent application, Ser. No. 564,489, filed on Dec. 22, 1983, said parent applications now abandoned.

BACKGROUND OF THE INVENTION

This invention relates to an attachable non-complex adaptive steering handle for trolling motors such as electrical trolling motors. The adaptive steering handle includes a lockable two part swivel, an adaptive shaft connected to one side of the swivel and a control handle shaft connected to the other side of the swivel.

In the past, conventional fishing boats were provided with a battery powered trolling motor, mounted on a vertical, submersible shaft, having a propeller on its depending end and angularly rotatably mounted on the boat at the forward end or aft end thereof for guiding the boat in accordance with the position of the propeller. The occupant of the boat may face the trolling motor and guide the propeller by a short projecting handle secured to the motor housing. However, this has the disadvantage that if the fishing boat is in motion the electrical motor is not readably accessible to the occupant who is also a fisherman. The fisherman needs an adjustable handle that is accessible to the fisherman no matter where he sits and is accessible to either of the fisherman's hands no matter which hand is free and available for use.

SUMMARY OF THE INVENTION

An attachable steering handle for an electric trolling motor includes a two part swivel, an adaptive shaft connected to one part of the swivel, and a control handle shaft connected to the other part of the swivel. The attachable steering handle is designed to be connectable to most types of electrical trolling motors. The adaptive shaft is connectable to the trolling motors submersible shaft. In an alternative embodiment the adaptive shaft is also connected to the motor control housing. The control handle shaft is positionable upward and downward from a horizontal position. The upper position is greater than sixty degrees to the horizontal position and a lower position that is greater than sixty degrees to the horizontal position. The motor may be stored with the steering handle positioned in a lower position generally parallel to the motor shaft or ninety degrees to the horizontal position.

The swivel includes two parts. The two parts include two disk shaped spacers with a center hole through each spacer. A bolt is passed through the holes in the spacers and the head of the bolt is welded to the first spacer. The second spacer is freely rotatable on the bolt. The spacers have mating flat faces. The second spacer is movable relative to the first spacer. The bolt has a threaded end that protrudes out of the hole in the second spacer. The clamping mechanism for locking the swivel spacers together in a fixed position relative to one another includes a handle in the form of a relatively long metal bar that is welded to one end of a short length of pipe to form a T-shaped configuration. The other end of the short length of pipe is connected to a threaded nut. The nut mates with the threaded end of the bolt. The opening in the pipe allows the threaded end of the bolt to move freely through the nut and into the opening in the pipe. The T-shaped handle allows a user to unlock and lock the steering handle's swivel in order to move the control handle shaft into any desired position.

In a second embodiment the second spacer includes a wing nut in place of the T-shaped handle mentioned above. The wing nut acts in the same manner to put pressure upon the two spacers and keep them in a locked position. However, in the second embodiment the wing-shaped nut also includes an Allen nut integral therewith. The Allen nut can provide secondary pressure on the external end of the bolt. The pressure applied by the Allen nut is separate and distinct from the pressure applied by the wing nut itself to lock the two spacers together. Thus the Allen nut provides an independent and auxiliary, force upon the unit. This embodiment is significant such that the pressure applied by the Allen nut allows the operator to move the control handle from one position to another, and thereby rotate the second spacer about the first spacer without causing the entire mechanism to come loose. That is, even though the control handle is moved, the Allen nut applies continuous pressure to the end of the bolt, and therefore even though the second disk is rotated, the wing nut continues to apply pressure to both spacers and thereby keep them in a "locked" position. It is the separate pressure applied by the auxiliary Allen nut which allows the control handle to be moved, and yet prevents the bolt from coming completely loose which would cause the control handle to drop under the pressure of gravity.

The adaptive shaft has a first end and a second end. The first end is connected to a U-shaped clamp means for connecting the adaptive shaft to the trolling motor shaft housing or trolling motor submersible shaft. The second end is connected to the edge or side of the first spacer.

In an alternative embodiment, a mounting plate is welded to the adaptive shaft between the first end and the second end. The intermediate portion of the adaptive shaft between the U-shaped clamp means and the mounting plate may be bent to any angle needed in order to connect the U-shaped clamp to the motor shaft and the mounting plate to the bottom of the control housing of the motor. The mounting plate has a plurality of holes therein for use in connecting the mounting plate to the control housing by bolts on sheet metal screws.

The U-shaped clamp includes a plate, a U-shaped bolt with threads on each end, and two threaded nuts. The plate is welded to the adaptive shaft and includes a cut-out portion in the form of a half circular. The half circle hole is cut in the plate along one side. The U-shaped member is placed in holes cut in the plate to position the U-shaped member in relationship with the half circular to form a full circle. The motor shaft may be placed in the half circular hole with the U-shaped member positioned around the motor shaft. The two threaded ends are passed through the holes in the plate and the nuts are placed on the threaded ends. The nuts may be tightened to clamp the U-shaped member around the motor shaft as a clamping means.

One end of the control handle shaft is connected to the edge of the second spacer. A rubber or a soft form, or plastic handle is connected to the other end of the control handle shaft. The control handle shaft may be bent into any position and the swivel may be used to vary the position of the handle.

It is an object of this invention to provide a non-complex attachable steering handle for an electric trolling motor that can be easily adjusted for attachment to the electric trolling motor.

It is another object to provide a steering handle that includes a non-complex lockable swivel, an adaptive shaft and a control handle shaft.

It is another object of this invention to provide a non-complex lockable swivel, which contains an auxiliary locking means, which acts in a secondary manner to apply pressure to the lockable swivel, in conjunction with a primary locking means.

It is a further object of this invention to provide an adaptive shaft with a clamp and a control housing plate welded thereto.

In accordance with these and other objects which will be apparent hereinafter, the instant invention will now be described with particular reference to the accompanying drawings.

DESCRIPTION OF THE INVENTION

Figure 1:
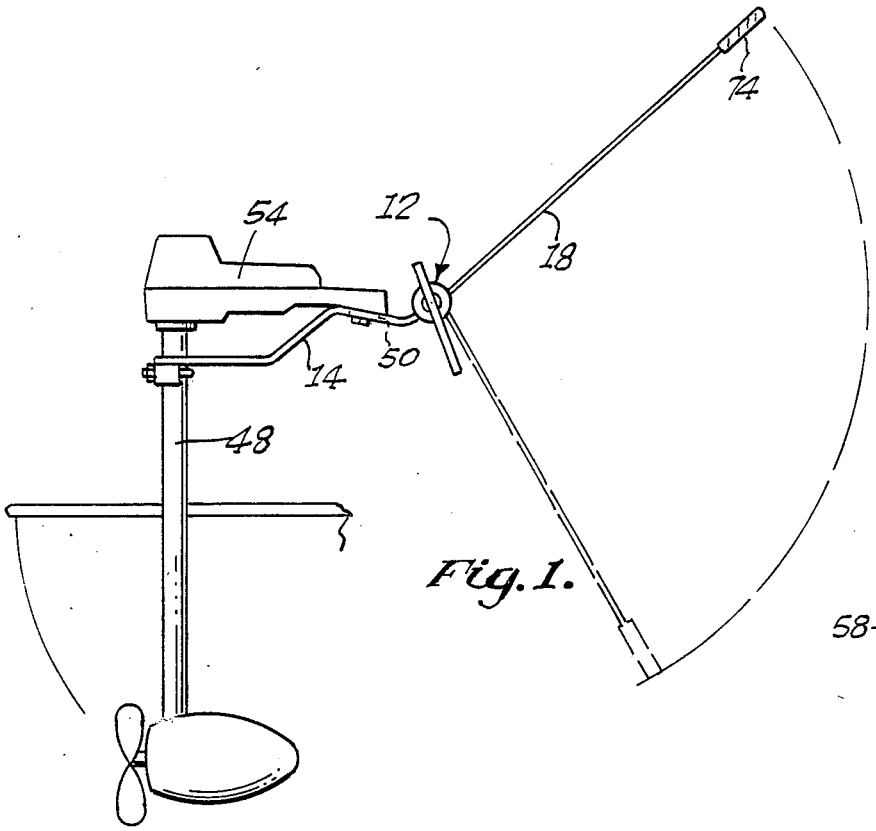
FIG. 1 is a side view of the steering handle and electric motor.
Figure 2:
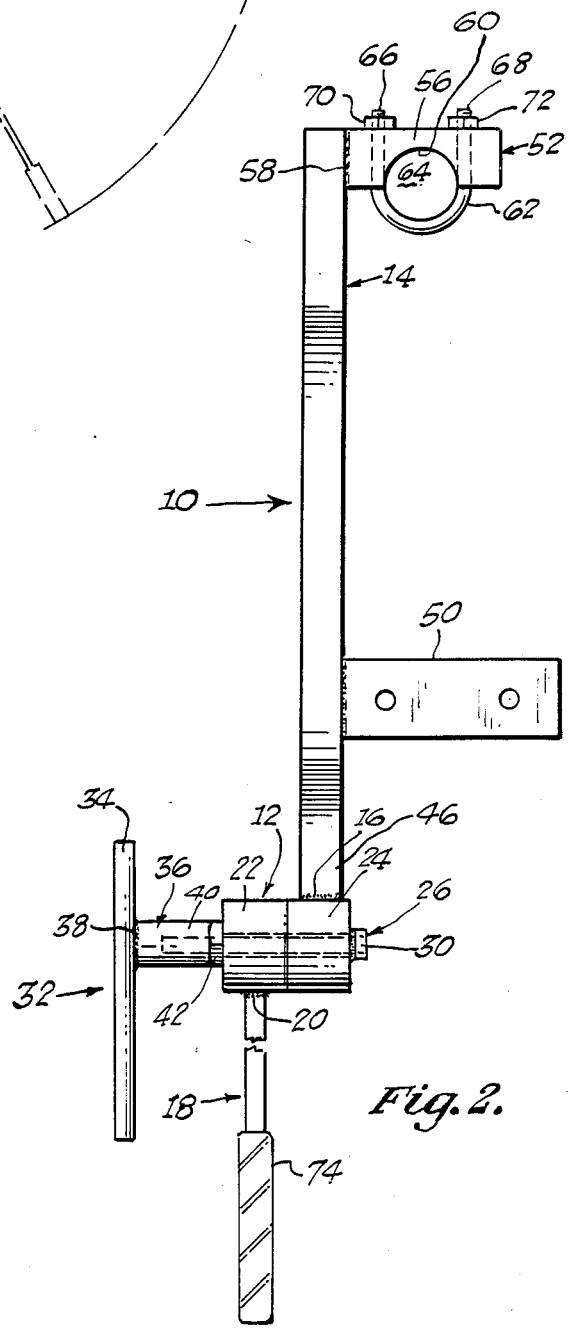
FIG. 2 is a top view of the steering handle.

Referring now to the drawings, the attachable steering handle 10 for an electric trolling motors is shown. The steering handle includes a swivel 12, an adaptive shaft 14 connected to one side of the swivel at 16, and a control handle shaft 18 connected to the other side of the swivel at 20. The attachable steering handle 10 is connectable to an electrical trolling motors by connecting the adaptive shaft 14 to the trolling motors submersible shaft or to the motor control housing. The control handle shaft is positionable at least between an upper and lower position with the control handle shaft 18 generally parallel to the motor shaft.

Figure 3:
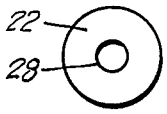
FIG. 3 is a front view illustrating the spacer of the invention.
Figure 4:
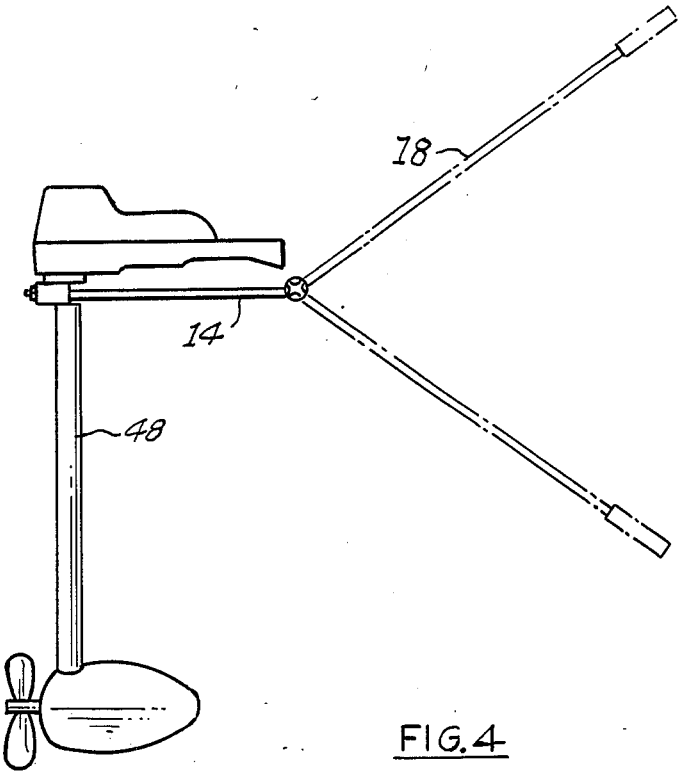
FIG. 4 is a side view illustrating an alternative embodiment of the steering handle and electric motor.
Figure 5:
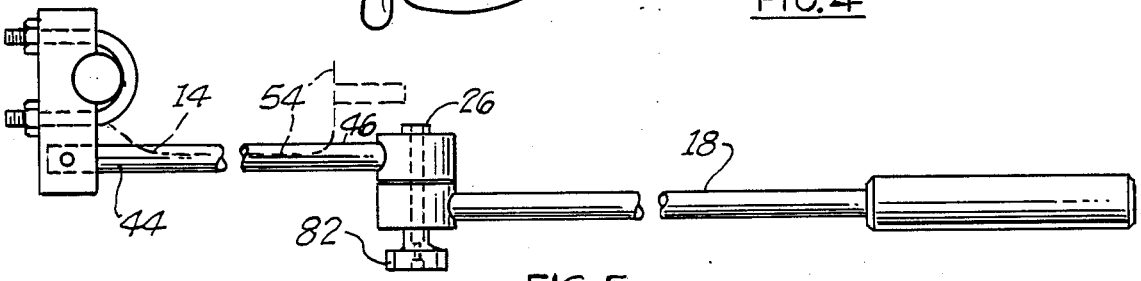
FIG. 5 is a top view of an alternative embodiment of the steering handle.

The swivel 12 includes two disk shaped spacers 22 and 24 with a center holes. A bolt 26 is passed through the holes 28 as shown in FIG. 3 in the spacers 22 and 24. The head 30 of the bolt 26 is welded to one spacer such as 24. The spacer 22 is freely rotatable on the bolt 26 relative to the first spacer 24. The bolt has a threaded end that protrudes out of the hole in the second spacer 22. The clamping mechanism 32 for locking the swivel spacers 22 and 24 in a fixed position relative to one another includes a handle 34 welded to a short length of pipe 36 in a T-shaped configuration. One end 38 of the pipe 36 is connected to the handle 34 that is a metal bar. The other end 40 of the pipe 36 is connected to a threaded nut 42. The nut 42 mates with the threaded end of the bolt 26. The pipe 36 allows the threaded end of the bolt 26 to move freely through the nut 42 and into the hollow inside of the pipe.

Referring to FIGS. 4, 5, 6 and 6A, an alternative embodiment of the invention is shown. In this embodiment the second rotatable spacer 22 is also freely rotatable around the first spacer 24. However in this embodiment, the primary locking means 80 is the wing nut 82 which is threadably secured about the bolt 26. The primary locking means includes a secondary or auxiliary locking means 84 which in this embodiment is an Allen nut 86 placed within the wing nut. The Allen nut can provide a separate and discrete pressure to the end of the bolt 26. Thus, the wing nut 82 can provide a primary locking pressure to the two disks by tightening the wing nut around the bolt 26 and thus applying pressure in a conventional manner.

However, the auxiliary locking means 84 provides a secondary pressure to the external end of the bolt 26. By tightening the Allen nut 86, pressure is applied to the far facial end of the bolt 26. This secondary pressure as applied by the Allen nut 86 allows an operator to move the control handle 18 from one first locked position to a second position for the convenience of the operator. The auxiliary locking means 84 allows pressure to be maintained on bolt 26 such that it does not become loose. Without the auxiliary locking means 84, if an operator were to move the control handle 18, the primary locking pressure applied by the wing nut, or the T-shaped handle as described above, may allow the locking mechanism to become loose. But it has been found that with the pressure applied by the Allen nut 86, the control handle 18 may be moved through a plurality of positions without the entire mechanism becoming loose.

Figure 6:
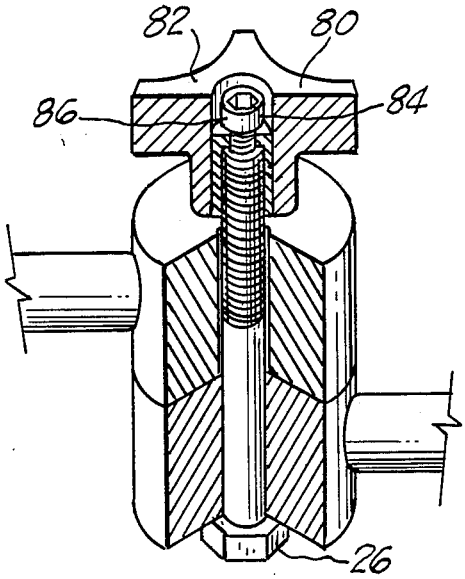
FIG. 6 is a perspective, cut away, view illustrating an alternative embodiment of the invention including the primary locking means and auxiliary locking means.
Figure 6A:
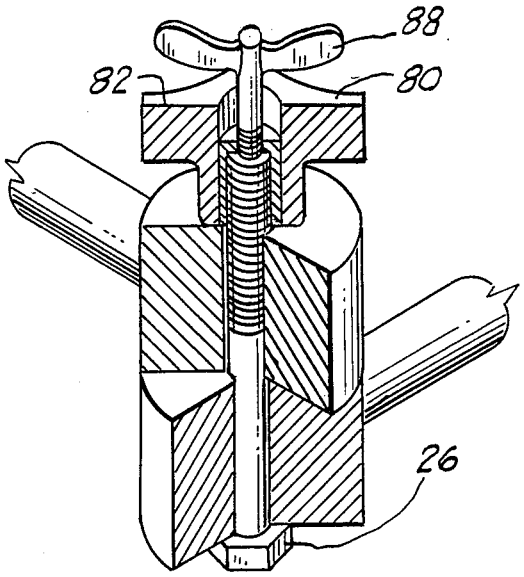
FIG. 6A is a perspective, cut away view, illustrating an alternative embodiment of the primary locking means and secondary locking means of the invention.

As illustrated in FIG. 6A, the auxiliary locking means 84 may also be a wing bolt 88 or other similar hardware.

The adaptive shaft 14 has a first end 44 and a second end 46. The first end 44 of the adaptive shaft 14 is connected to the trolling motor submersible shaft 48. The second end 46 is connected to the edge of the first space 24.

In one embodiment a mounting plate 50 is welded to the adaptive shaft 14. The intermediate portion of the adaptive shaft 14 between the U-shaped clamp means 52 and the first spacer 24 is bent to any configuration that may be needed in order to connect the U-shaped clamp 52 to the motor shaft and the mounting plate 50 to the control housing 54 of the motor. The mounting plate 50 has holes drilled therein to connect the mounting plate 50 to the control housing by bolts on sheet metal screws.

In a second embodiment, as illustrated in FIGS. 4 through 6A, the adapted shaft is connected directly to the submersible shaft of the trolling motor. That is, there is no mounting plate or connection to the trolling motor housing itself, and the adapter shaft and the clamping means are directly connected to the submersible shaft of the trolling motor. This embodiment allows ease in connection by the operator, and will likewise facilitate operation with a plurality of commercial available units.

The U-shaped clamp 52 includes a plate 56 welded to the adaptive shaft 14 at 58. The plate includes a half circular hole 60 cut in one side of the plate 56. The U-shaped member 62 is placed in holes that are drilled through the plate to allow positioning of the U-shaped member 62 in the holes in order to form a circular hole 64 in which the motor may be placed. The motor shaft is placed in the circular hole 64 formed by the plate 56 and U-shaped clamp 62. The ends 66 and 68 of the U-shaped member 62 are threaded and the nuts 70 and 72 may be placed on the end. The nuts and may be adjusted to secure the clamp means 62 around the motor shaft 48.

One end of the control handle shaft 18 is connected to the edge of the second spacer 22. A rubber or a soft form, or plastic handle 74 is connected to the other end of the control handle shaft 18. The control handle shaft may be moved up and down through the use of the swivel 12. The control handle shaft 18 may be bent to conform to the particular desires of the user.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A steering handle attachment connected directly to the submersible shaft of electric trolling motors, said trolling motor having a propeller assembly and a control housing, comprising:

a swivel connected to one side of said submersible shaft, said submersible shaft supporting the propeller assembly of said trolling motor, said submersible shaft generally vertically positioned during operation of said trolling motor, said swivel having a freely rotatable swivel portion;

said swivel having a locking means, said locking means including a primary locking means and an auxiliary locking means, for maintaining said swivel in a predesired, locked position;

an adaptive shaft connected directly between said swivel and said submersible shaft, said adaptive shaft connected to said one side of said submersible shaft;

a control handle shaft connected to said freely rotatable swivel portion in order to adjustably connect said control handle shaft to said adaptive shaft, said control handle shaft connected outward of said adaptive shaft in respect to said submersible shaft;

said control handle shaft being movable upward and downward to a position generally parallel to said submersible shaft;

said adaptive shaft including a clamp means connected to one end of said adaptive shaft, said clamp means connectable to said trolling motor submersible shaft; and a mounting plate connected to said adaptive shaft between said clamp means and said swivel, said mounting plate connectable to the control housing of the trolling motor.

2. A steering handle attachment connected directly to the submersible shaft of electric trolling motors as set forth in claim 1, wherein:

said swivel including a first spacer connected to said adaptive shaft, said freely rotatable swivel portion including a second spacer connected to said control handle shaft, a clamp down handle having a threaded swivel member, and a mating swivel axle connected to one of said spacers and passing through the other said spacer to provide said locking means for said swivel.

3. A steering handle attachment connected directly to the submersible shaft of electric trolling motors as set forth in claim 2, wherein:

said adaptive shaft has a first and second end;

said second end of said adaptive shaft connected to said first spacer of said swivel;

said control handle shaft having a first end connected to said second spacer of said swivel, said control handle shaft having a soft handle at the other end of said control handle shaft;

whereby said adaptive shaft may be bent to adapt said steering handle attachment to said electric trolling motors.

4. A steering handle attachment connected directly to the submersible shaft of electric trolling motors as set forth in claim 1, wherein:

said control handle being movable upward and downward from a position perpendicular to said submersible shaft, said upward position greater than sixty degrees above the perpendicular position and said downward position generally parallel to said submersible shaft.

5. A steering handle attachment connected directly to the submersible shaft of electric trolling motors as set forth in claim 1, wherein:

said control handle shaft is of a length approximately equal in length to said submersible shaft and movable about three hundred and sixty degrees with said freely rotatable swivel portion.

6. A steering handle attachment connected directly to the submersible shaft of electric trolling motors as set forth in claim 1, wherein:

said swivel including a first spacer connected to said adaptive shaft, said freely rotatable swivel portion including a second spacer connected to said control handle shaft, said swivel including said locking means, said locking means including a primary locking means and an auxiliary locking means, said locking means enabling said swivel to be positioned in a plurality of locations, whereby said primary locking means provides a general locking pressure to said swivel, and said auxiliary locking means provides a secondary pressure, wherein said swivel can be moved through a plurality of locked positions without said swivel losing locking pressure.

7. A steering handle attachment as set forth in claim 6, wherein:

said swivel further includes a bolt; said primary locking means is a wing nut threadably secured about said bolt of said swivel.

8. A steering handle attachment as set forth in claim 7, wherein:

said auxiliary locking means is an Allen nut mounted within said wing nut, said Allen nut supplying said secondary pressure to the bolt of said swivel, wherein said primary locking means provides a first pressure to said swivel, and said auxiliary means provides a second pressure to the bolt of said swivel, whereby said swivel can be moved from a first locked position to a second locked position without said swivel losing locking pressure.

9. A steering handle attachment connected directly to the submersible shaft of an electric trolling motor, said trolling motor having a propeller assembly and a control housing, comprising:

a swivel;

an adaptive shaft connected to said swivel;

a control handle shaft connected to said swivel in order to adjustably connect said control handle shaft to said adaptive shaft;

said adaptive shaft including a clamp means connected to one end of said adaptive shaft, said clamp means connectable to said submersible shaft of said trolling motor, said submersible shaft supporting the propeller assembly of said trolling motor, said submersible shaft generally vertically positioned during operation of said trolling motor;

said swivel including a primary locking means and an auxiliary locking means; and a mounting plate connected to said adaptive shaft between said clamp means and said swivel, said mounting plate connectable to the control housing of the trolling motor.

* * * * *